US006746263B2

(12) United States Patent
Luo

(10) Patent No.: US 6,746,263 B2
(45) Date of Patent: Jun. 8, 2004

(54) SOCKET CONNECTOR HAVING BLIND MATING STRUCTURE

(75) Inventor: Jiejun Luo, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/423,186

(22) Filed: Apr. 24, 2003

(65) Prior Publication Data

US 2004/0014348 A1 Jan. 22, 2004

(30) Foreign Application Priority Data

Jul. 18, 2002 (TW) ..... 91210914 U

(51) Int. Cl.[7] ..... H01R 4/50
(52) U.S. Cl. ..... 439/342
(58) Field of Search ..... 439/264, 268, 439/342

(56) References Cited

U.S. PATENT DOCUMENTS 6,419,514 B1 * 7/2002 Yu ..... 439/342
6,431,899 B1 * 8/2002 Keller ..... 439/342
6,471,534 B1 * 10/2002 Lee ..... 439/342

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

A socket connector (1) for electrically connecting a CPU to a PCB includes a base (2), a cover (3) slidably mounted on the base, an actuator (4) received between the base and the cover, and a plurality of electrical contacts (5) received in the base. The base forms blocks (226, 228) at opposite lateral sides (221, 223) thereof. The blocks have different lengths along a direction of sliding of the cover on the base. The cover forms side walls (326, 328) having different lengths along said direction, corresponding to the blocks. Among a range of similar socket connectors, each socket connector has a base with unique different lengths and a cover with corresponding unique different lengths. Thus the blocks of the base can only be mated with the side walls of the correct corresponding cover. Mismating of the base with a non-matching cover, or vice versa, is prevented.

6 Claims, 4 Drawing Sheets

SOCKET CONNECTOR HAVING BLIND MATING STRUCTURE

BACKGROUND OF THE INVENTION

1. Field of the Invention

The present invention relates to an electrical socket connector, and more particularly to a central processing unit (CPU) socket connector for electrically connecting a CPU to a printed circuit board (PCB).

2. Description of the Prior Art

Conventionally, a CPU socket connector includes a base, a cover slidably mounted on the base, a plurality of contacts received in the base, and an actuator sandwiched between the cover and the base for urging the cover to move relative to the base. The base defines an array of passageways for accommodating the contacts therein, respectively. The cover defines an array of holes corresponding to the passageways for insertion of pins of a CPU therethrough. The contacts are adapted to mechanically engage with the pins to achieve electrical engagement between the CPU and the socket connector. Precise engagement between the pins and the contacts is very important for reliable electrical transmission. Accurate engagement depends in large part on correct attachment of the cover on the base. This can be problematic in environments such as mass production facilities where various connectors having slightly different bases and covers are assembled. Mismatching of non-corresponding bases and covers can occur.

FIG. 5 shows a conventional CPU socket connector 6 as disclosed in Taiwan Pat. No. 388570. The connector 6 includes a base 62, a cover 63 slidably mounted on the base 62, a plurality of contacts 64 received in the base 62, and an actuator 65 received between the base 62 and the cover 63 for actuating the cover 63 to move relative to the base 62. The cover 63 has sidewalls 630 at opposite lateral sides thereof. The sidewalls 630 define recesses 632 therein. The base 62 forms blocks 620 corresponding to the recesses 632, respectively. The blocks 620 are slidably engaged in the recesses 632 respectively, thus mounting the cover 63 onto the base 62. However, in the electrical connector industry, a variety of connectors 6 may be manufactured, each connector 6 having a configuration similar to other of the connectors 6. In particular, the connectors 6 may have slightly different bases 62 but with the same blocks 620, and slightly different covers 63 but with the same recesses 632. No blind mating means are provided on the bases 62 or the covers 63. As a result, mismating between the bases and the covers can easily occur.

U.S. Pat. No. 5,167,515 discloses another CPU socket connector. The CPU socket connector includes a base, a cover slidably mounted on the base, a plurality of contacts secured in the base, and an actuator received between the cover and the base. The cover forms hooks at opposite lateral sides thereof. The base forms blocks corresponding to the hooks. The blocks are slidably engaged with the hooks so as to mount the cover onto the base. Neither the base nor the cover provides blind mating means. The socket connector is liable to mismating as described above. Further, CPU sockets disclosed in U.S. Pat. Nos. 5,454,727 and 5,489,217 also have this same disadvantage.

Accordingly, there is a need to provide a new CPU socket connector with a blind mating retention structure that overcomes the above-mentioned problems.

SUMMARY OF THE INVENTION

An object of the present invention is to provide a socket connector having blind mating means for ensuring correct attachment of a cover to its corresponding base.

To achieve the above object, a CPU socket connector for electrically connecting a CPU to a PCB is provided by the present invention. The CPU socket connector comprises a base, a cover slidably mounted on the base, an actuator received between the cover and the base for urging the cover to move relative to the base, and a plurality of electrical contacts received in the base. The base forms first and second blocks at opposite lateral sides thereof. The first and second blocks have different lengths along a direction of sliding of the cover on the base. The cover forms first and second side walls having different lengths along said direction, corresponding to the first and second blocks.

For the CPU socket connector of the present invention, a range of slightly different bases may be manufactured. Each base is configured with first and second blocks having unique predetermined different lengths along said direction. Correspondingly, a range of slightly different covers may be manufactured for the CPU socket connector. Each cover is configured with first and second side walls having unique predetermined different lengths along said direction. The various configurations of the first and second side walls of the covers respectively and uniquely correspond to the various configurations of the first and second blocks of the bases. Thus for each CPU socket connector, the first and second blocks of the base can only be mated with the first and second side walls of the correct corresponding cover. Mismating of the base with a non-matching cover, or vice versa, is prevented. As a result, correct mechanical and electrical engagement between the pins of the CPU and the contacts is assured.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
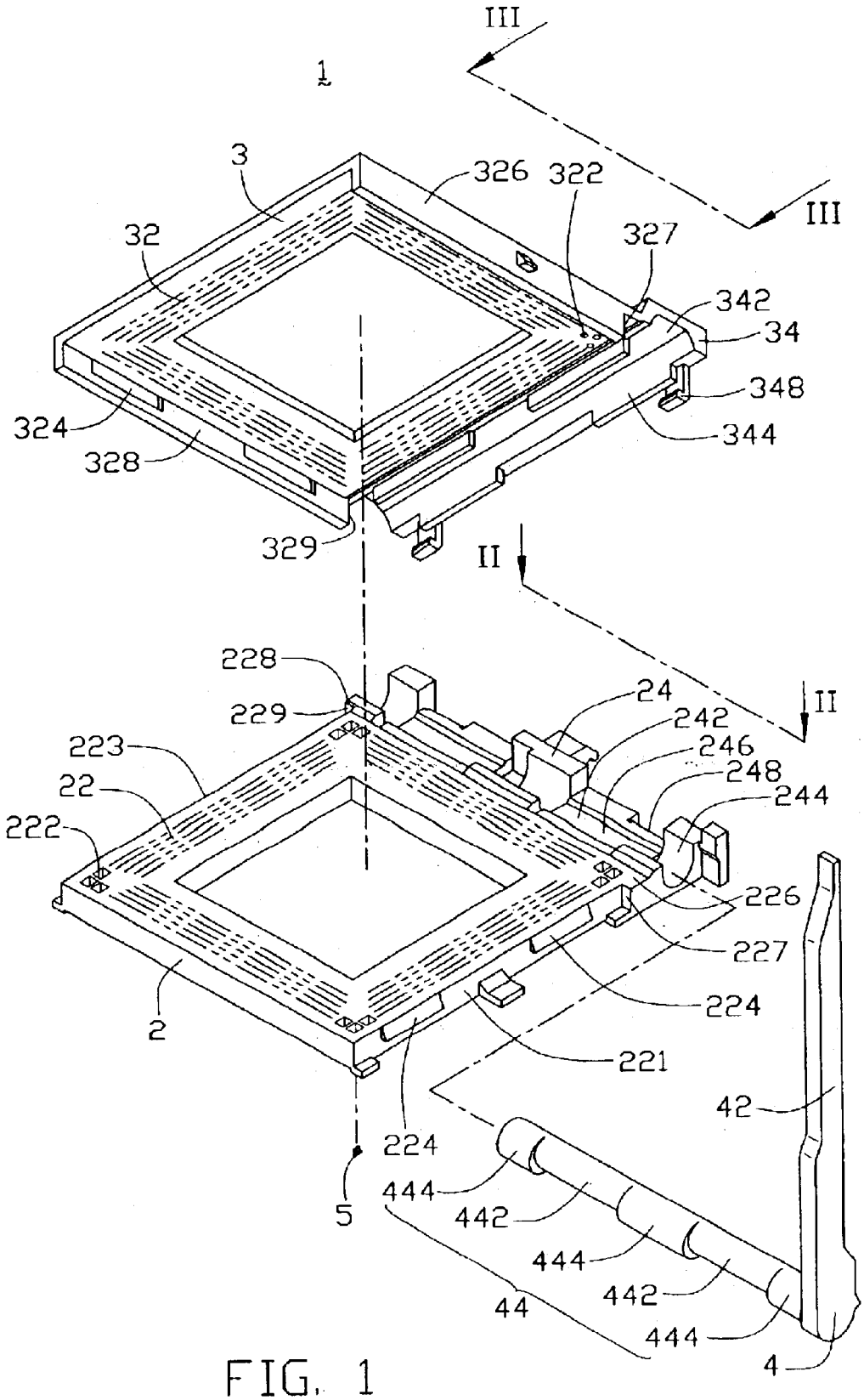
FIG. 1 is a simplified, exploded isometric view of a CPU socket connector in accordance with the present invention, the connector comprising a cover and a base, the cover being viewed from a different aspect to that of the base.

Referring to FIG. 1, a CPU socket connector 1 in accordance with a preferred embodiment of the present invention is used to electrically connect a CPU to a PCB (not shown). The CPU socket connector 1 comprises a housing structure having an insulative base 2 and a cover 3 slidably mounted on the base 2, an actuator 4 received between the base 2 and the cover 3 for urging the cover 3 to slide relative to the base 2, and a plurality of electrical contacts 5 received in the base 2.

The base 2 has a main body 22, and a first header portion 24 extending from one end of the main body 22. The main body 22 defines opposite first and second lateral sides 221, 223. The main body 22 also defines an array of passages 222 therethrough for securing the contacts 5 therein respectively.

Figure 2:
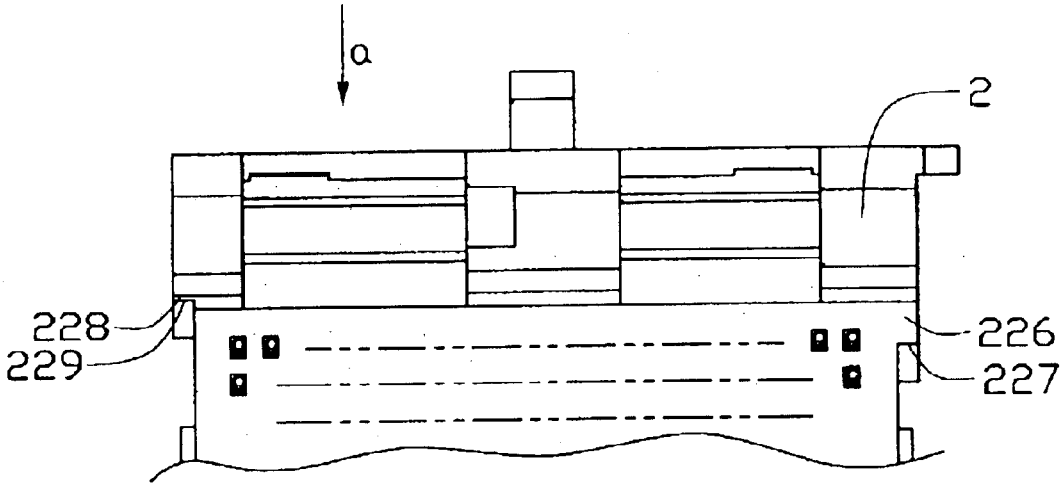
FIG. 2 is a top elevation view of part of the base of FIG. 1, corresponding to line II—II of FIG. 1.

Each lateral side 221, 223 forms two protrusions 224 extending therefrom. The protrusions 224 each have a triangular cross-section, and are spaced apart from each other a predetermined distance. The first lateral side 221 forms a first block 226 extending perpendicularly therefrom and adjacent to the first header portion 24. The second lateral side 223 forms a second block 228 extending perpendicularly therefrom and adjacent to the first header portion 24. Referring also to FIG. 2, the first and second blocks 226, 228 have different lengths along a direction 'a,' and respectively define first and second mating faces 227, 229 thereon. Accordingly, the first and second mating faces 227, 229 are offset from each other along direction 'a.'

The first header portion 24 defines a first channel 242 therethrough. The first channel 242 comprises three spaced arcuate positioning slots 244 respectively interspersed by two rectangular urging recesses 246. A cross-section of each urging recess 246 is trapezoidal. A pair of spaced first hook portions 248 depends from a distal edge of the first header portion 24.

The cover 3 has a main plate 32, and a second header portion 34 extending from one end of the main plate 32. The main plate 32 and second header portion 34 correspond to the main body 22 and first header portion 24 respectively of the base 2.

Figure 3:
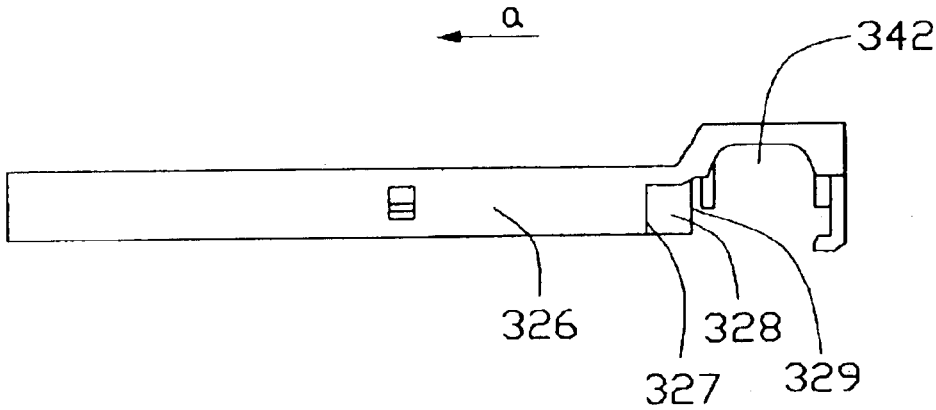
FIG. 3 is a side elevation view of the cover of FIG. 1, corresponding to line III—III of FIG. 1.

The main plate 32 defines an array of holes 322 corresponding to the passages 222 of the base 2. The holes 322 are for insertion of pins of the CPU therethrough. A first side wall 326 and a second side wall 328 depend from opposite lateral sides of the cover 3, respectively. Referring also to FIG. 3, the first and second side walls 326, 328 have different lengths along direction 'a,' and respectively define third and fourth mating faces 327, 329 thereon. Accordingly, the third and fourth mating faces 327, 329 are offset from each other along direction "a." The first and second side walls 326, 328 each defines two sliding slots 324 for slidably receiving the protrusions 224 of the base 2 therein.

The second header portion 34 defines a second channel 342 therethrough, corresponding to the first channel 242 of the base 2. The second header portion 34 comprises an actuating plate 344 depending from a distal end thereof, alongside the second channel 342. A pair of spaced second hook portions 348 depends from a distal edge of the second header portion 34, corresponding to the first hook portions 248 of the base 2.

The actuator 4 comprises a shaft 44, and an actuating lever 42 extending perpendicularly from the shaft 44. The shaft 44 comprises three spaced cylindrical positioning portions 444 respectively interspersed by two urging portions 442. The shaft 44 is rotatably received in a cavity cooperatively defined by the first and second channels 242, 342. The positioning portions 444 are received in the positioning slots 244 to locate the actuator 4 therein. The urging portions 442 are received in the urging recesses 246, and engage with the actuating plate 344 to urge the cover 3 to move relative to the base 2.

Figure 4:
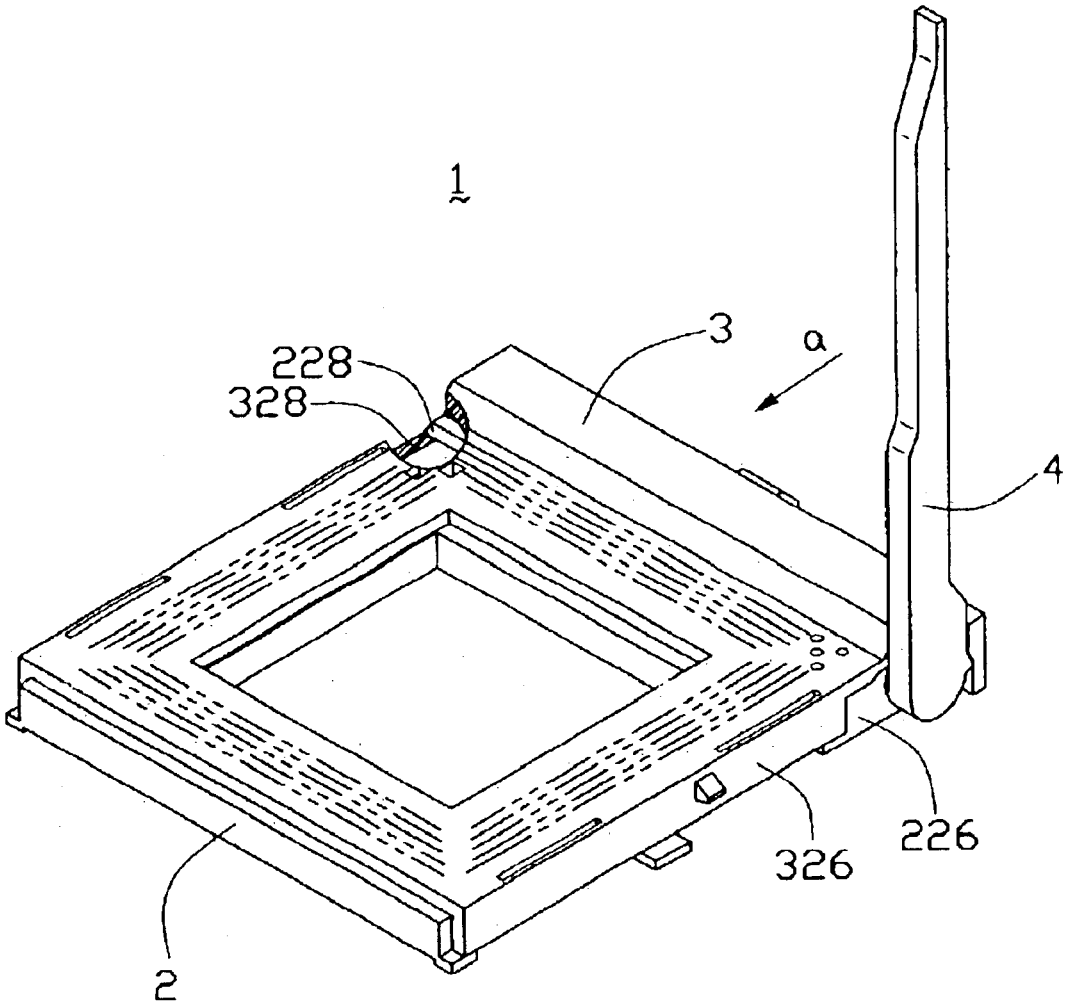
FIG. 4 is an assembled view of FIG. 1.
Figure 5:
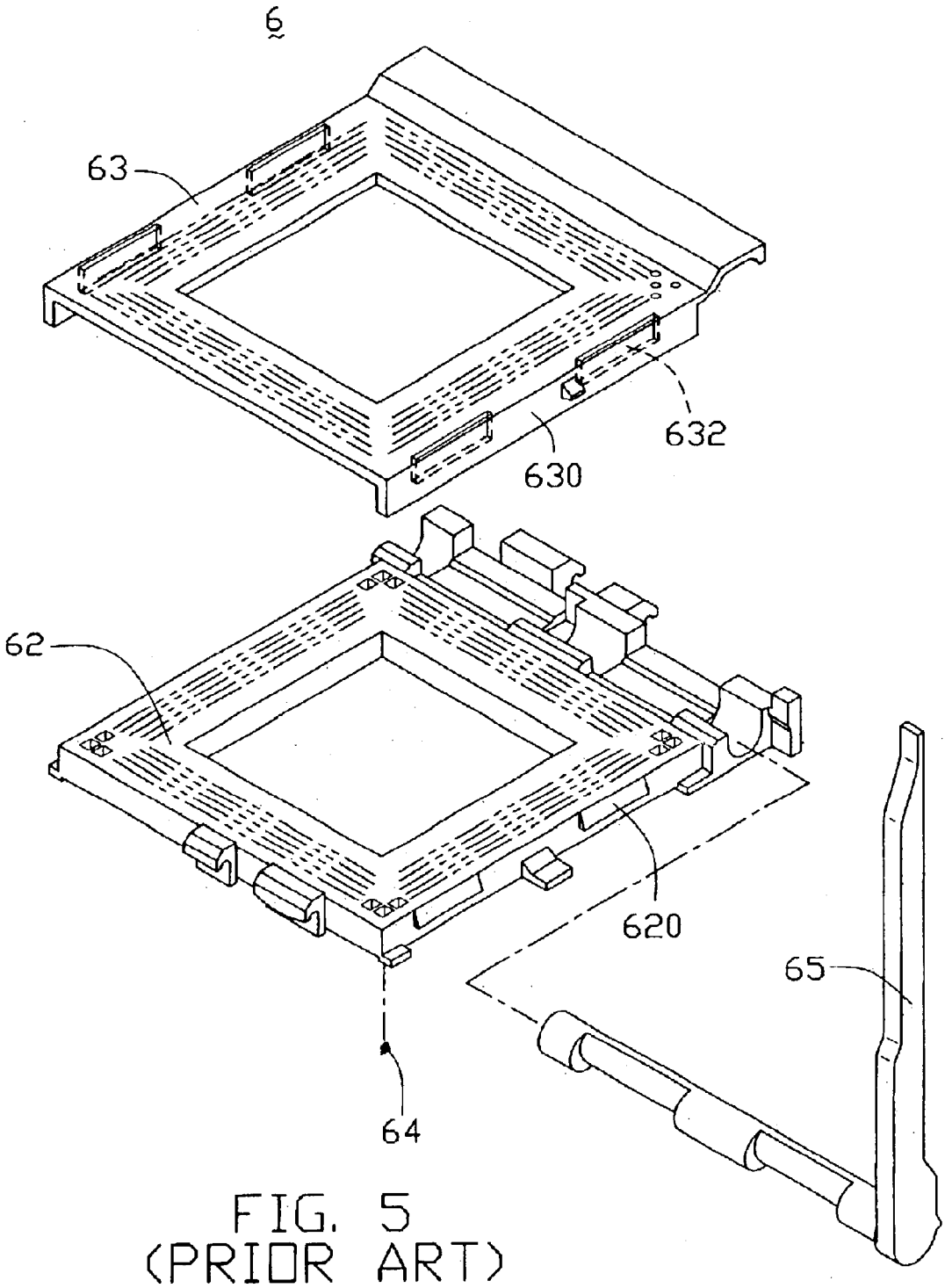
FIG. 5 (PRIOR ART)
FIG. 5 is a simplified, exploded isometric view of a conventional CPU socket connector.

Referring to FIG. 4, in assembly of the CPU socket connector 1, the positioning portions 444 and the urging portions 442 of the actuator 4 are rotatably received in the positioning slots 244 and the urging recesses 246 respectively. The cover 3 is then mounted onto the base 2. The protrusions 224 of the base 2 are slidably engaged in the sliding slots 324 of the cover 3, and the first hook portions 248 of the base 2 are engaged with the second hook portions 348 of the cover 3.

The first and second blocks 226, 228 of the base 2 have different lengths along direction 'a,' and the first and second side walls 326, 328 also have different lengths along direction 'a.' Accordingly, the first and second blocks 226, 228 mate with the first and second side walls 326, 328 asymmetrically. Thus the cover 3 can be correctly mounted on its corresponding matching base 2.

In the electrical connector industry, a range of similar electrical socket connectors are made. For the CPU socket connector 1 of the present invention, a range of slightly different bases 2 may be manufactured. Each base 2 is configured with first and second blocks 226, 228 having unique predetermined different lengths along direction 'a.' Correspondingly, a range of slightly different covers 3 may be manufactured for the CPU socket connector 1 of the present invention. Each cover 3 is configured with first and second side walls 326, 328 having unique predetermined different lengths along direction 'a.' The various configurations of the first and second side walls 326, 328 of the covers 3 respectively and uniquely correspond to the various configurations of the first and second blocks 226, 228 of the bases 2. Thus for each CPU socket connector 1, the first and second blocks 226, 228 of the base 2 can only be mated with the first and second side walls 326, 328 of the correct corresponding cover 3. Mismating of the base 2 with a non-matching cover 3, or vice versa, is prevented. Correct mechanical and electrical engagement between the pins of the CPU and the contacts 5 is assured.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An electrical socket connector comprising:

an insulative base defining an array of passages for receiving electrical contacts therein, and asymmetrically forming blocks at opposite lateral sides thereof; and a cover slidably mounted on the base, and having mating means corresponding to the blocks;

wherein the blocks have different lengths along a direction of sliding of the cover on the base, and the blocks asymmetrically mate with the mating means of the cover;

wherein the mating means comprises first and second side walls depending from opposite lateral sides of the cover, respectively, and the first and second side walls have different lengths along the direction;

wherein the base includes a first main body with a first header portion on a front portion thereof, the cover includes a second main body vertically aligned with the first main body, with a second header portion located on a front portion of the second main body and vertically aligned with the first header portion and the blocks and the mating means are located around the first and second header portions while far away from center portions of the first and second main bodies;

wherein a pair of spaced first hook portions depends from a distal edge of the first header portion and a pair of spaced second hook portions depends from a distal edge of the second header portion, which is corresponding to the first hook portions.

2. The socket connector of claim 1, wherein the blocks comprise first and second blocks respectively formed on the opposite lateral sides of the base.

3. The socket connector of claim 2, wherein the first and second blocks respectively have first and second mating faces offset from each other along said direction.

4. The socket connector of claim 1, wherein the first and second side walls respectively have third and fourth mating faces offset from each other along said direction.

5. The socket connector of claim 4, further comprising an actuator for urging the cover to slide on the base.

6. The housing of claim 1, wherein the base defines a plurality of passages therethrough, and the cover defines a plurality of boles respectively corresponding to the passages.

* * * * *